United States Patent [19]

Noro

[11] Patent Number: 4,922,469

[45] Date of Patent: May 1, 1990

[54] ACOUSTIC CHARACTERISTICS CHANGING DEVICE HAVING VARIABLE CHARACTERISTICS

[75] Inventor: Masao Noro, Hamamatsu, Japan

[73] Assignee: Yamaha Corporation, Hamamatsu, Japan

[21] Appl. No.: 347,175

[22] Filed: May 3, 1989

[30] Foreign Application Priority Data

May 6, 1988 [JP] Japan ..... 63-110944
Jun. 7, 1988 [JP] Japan ..... 63-140161

[51] Int. Cl.[5] ..... G10K 11/00

[52] U.S. Cl. ..... 367/140; 367/152; 181/175; 181/206

[58] Field of Search ..... 367/140, 152; 181/175, 181/206, 196, 197, 198, 207, 186, 211

[56] References Cited

FOREIGN PATENT DOCUMENTS 2157134 10/1985 United Kingdom ..... 181/175

*Primary Examiner*—Charles T. Jordan
*Assistant Examiner*—J. Woodrow Eldred
*Attorney, Agent, or Firm*—Spensley Horn Jubas & Lubitz

[57] ABSTRACT

An acoustic characteristics changing device includes a frame member disposed in an acoustic energy field, electro-acoustic conversion means attached to the frame member to constitute at least a portion of the device, variable impedance means connected as an electrical load to the electro-acoustic conversion means, and impedance control means for controlling an equivalent impedance of the variable impedance means. The equivalent impedance is variably controlled, so that an acoustic impedance and then its decrease frequency or decrease amount can be electrically, continuously and finely controlled.

4 Claims, 7 Drawing Sheets

ACOUSTIC CHARACTERISTICS CHANGING DEVICE HAVING VARIABLE CHARACTERISTICS

BACKGROUND OF THE INVENTION 1. (Field of the Invention)

The present invention relates to an acoustic characteristics changing device and, more particularly, to an acoustic characteristics changing device which can electrically control passive characteristics with respect to an acoustic energy.

2. (Description of the Prior Art)

As a technique of this field, an acoustic panel and an acoustic switch are known. Examples of the acoustic panel are disclosed in Japanese Utility Model Publication No. sho 54- 4334, and Japanese Utility Model Application No. sho 61-32910. According to the former example, an acoustic panel in which a reflection material is attached to the front surface and a sound absorption material is attached to the rear surface is reversed, so that the acoustic panel can be selectively used as the reflection panel and the sound absorption panel. According to the latter example, a pivotal door is arranged on the front surface of a sound absorption panel, and is pivoted to finely adjust acoustic characteristics of the panel as a whole. On the other hand, as the acoustic switch, keys of wind instruments or the like are known. When a sound insulation material is moved in an acoustic path, an acoustic impedance can be switching-controlled between an infinite level and zero.

However, the conventional acoustic characteristics changing device controls the acoustic impedance by mechanically moving the sound insulation material along the acoustic path or mechanically switching between an acoustic reflection member and an acoustic transmission member. For this reason, the mechanical switching mechanism is complicated, and it is not easy to finely adjust passive characteristics with respect to an acoustic energy. Furthermore, even when a sound absorption factor can be changed to some extent, a sound absorption frequency cannot be controlled.

SUMMARY OF THE INVENTION

It is an object of the present invention to provide an acoustic characteristics changing device which can achieve electrical control of an acoustic impedance, and can continuously and finely control the acoustic impedance.

An acoustic characteristics changing device of the present invention comprises: a frame member of the device disposed in an acoustic energy field; electro-acoustic conversion means attached to the frame member to constitute at least a portion of the device; variable impedance means connected as an electrical load to the electro-acoustic conversion means; and impedance control means for controlling an equivalent impedance of the variable impedance means.

According to a first aspect of the present invention, the variable impedance means can control the equivalent impedance from a positive region to a negative region. The impedance control means changes the equivalent impedance of the variable impedance means, thereby arbitrarily controlling an acoustic impedance of the electro-acoustic conversion means with respect to an acoustic energy of the acoustic energy field.

According to the above arrangement, when the equivalent impedance of the variable impedance means is controlled by the impedance control means, the acoustic impedance of the electro-acoustic conversion means with respect to the acoustic energy of the acoustic energy field can be arbitrarily controlled. The acoustic impedance is electrically controlled, and hence, passive characteristics with respect to the acoustic energy can be continuously and finely changed According to a second aspect of the present invention, the variable impedance means has a negative impedance means for equivalently eliminating or invalidating an internal impedance inherent in the electro-acoustic conversion means, and a capacitive or inductive reactance component connected in series with the negative impedance means, and selectively has an additional resistance component connected in parallel with the reactance component. The reactance component or the resistance component can be varied. The impedance control means changes the reactance component or the resistance component of the variable impedance means, thereby arbitrarily controlling a frequency of decrease of the acoustic impedance of the electroacoustic conversion means with respect to the acoustic energy of the acoustic energy field or its decrease amount.

According to the above arrangement, the reactance component or the resistance component of the variable impedance means is controlled by the impedance control means, thereby arbitrarily controlling a frequency of decrease of the acoustic impedance of the electro-acoustic conversion means with respect to the acoustic energy of the acoustic energy field or its decrease amount. The acoustic impedance is electrically controlled, and hence, passive characteristics with respect to the acoustic energy can be continuously and finely changed.

DESCRIPTION OF THE PREFERRED EMBODIMENTS

Figure 1:
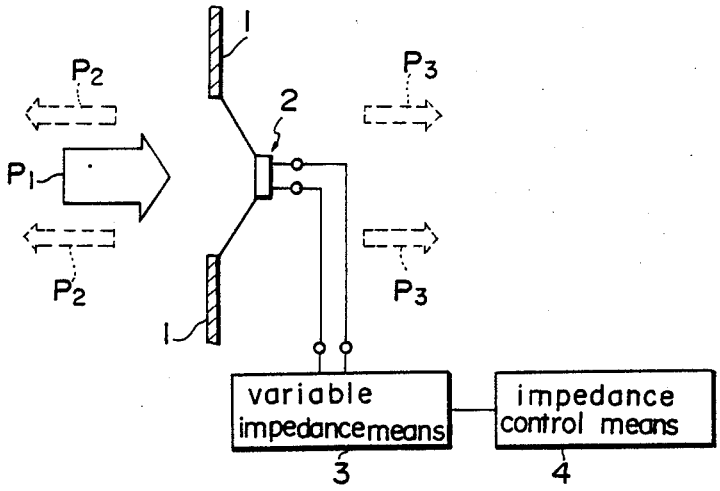
FIG. 1 is a block diagram showing a basic arrangement of a first embodiment of the present invention.

Preferred embodiments of the present invention will now be described with reference to FIGS. 1 to 10. Note that the same reference numerals denote the same parts throughout the drawings, and a repetitive description thereof will be avoided.

(First Embodiment)

FIG. 1 is a block diagram showing a basic arrangement of a first embodiment of the present invention. As shown in FIG. 1, a dynamic cone speaker as an electro-acoustic conversion means 2 is attached to a frame member 1. The electro-acoustic conversion means 2 is connected to a variable impedance means 3. An impedance control means 4 is also connected to the variable impedance means 3. The variable impedance means 3 serves as an electrical load of the electroacoustic converter means 2, and an equivalent impedance $Z_O$ generated by the means 3 can be varied from a positive region to a negative region. The impedance control means 4 continuously and finely controls the equivalent impedance $Z_O$ of the variable impedance means 3.

Figure 2:
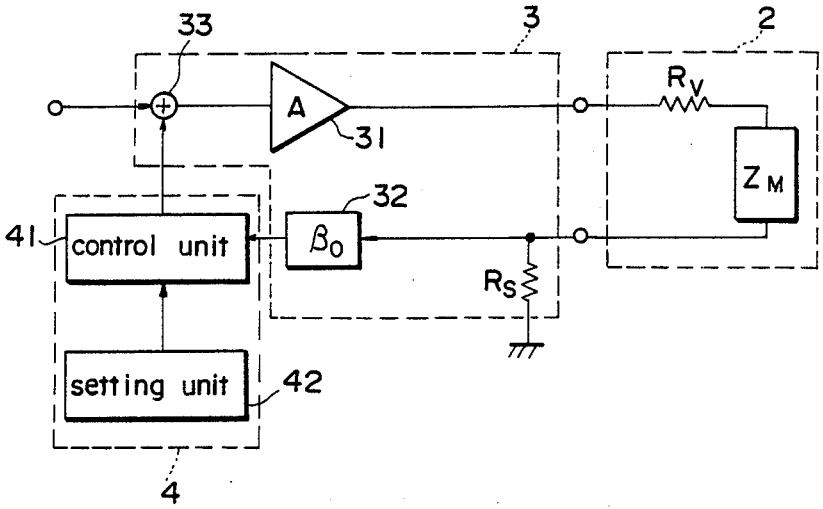
FIG. 2 is a detailed circuit diagram of the basic arrangement shown in FIG. 1.

A detailed circuit arrangement of FIG. 1 is as shown in FIG. 2. The electro-acoustic conversion means 2 has an inherent internal impedance $R_V$ and motional impedance $Z_M$. The internal impedance $R_V$ is connected to the output terminal of the variable impedance means 3 as the electrical load. The variable impedance means 3 has an amplifier 31 of a gain A, a detection resistor $R_S$ for detecting a current flowing through the electro-acoustic conversion means 2, a feedback circuit 32 for feeding back the detection output of the detection resistor $R_S$ with an inherent transmission gain $\beta_O$, and an adder 33 for adding an input signal and a feedback signal from the feedback circuit 32. The impedance control means 4 has a control unit 41 for effectively controlling a transmission gain $\beta$ (an apparent transmission gain different from the transmission gain $\beta_O$ inherent in the feedback circuit 32), and a setting unit 42 for arbitrarily setting a control amount of the unit 41.

In the circuit shown in FIG. 2, the equivalent impedance $Z_O$ of the variable impedance means 3 as the electrical load when no impedance control means 4 is arranged is given by:

$$Z_O = R_S(1 - A\beta_O) \quad (1)$$

Therefore, when $A\beta_O < 1$, the equivalent impedance $Z_O$ becomes positive, and when $A\beta_O > 1$, becomes negative. When the transmission gain $\beta_O$ can be effectively controlled, the equivalent impedance $Z_O$ of the variable impedance means 3 can be desirably controlled from a positive region to a negative region.

Thus, the control unit 41 is constituted by, e.g., a multiplier to provide a transmission gain $\beta$ obtained by apparently varying the fixed transmission gain $\beta_O$ inherent in the feedback circuit 32 by changing its multiplication factor. Thus, equation (1) can be rewritten as:

$$Z_O = R_S(1 - A\beta) \quad (2)$$

Therefore, when the value of the transmission gain $\beta$ is effectively changed by the setting unit 42, the equivalent impedance $Z_O$ can be varied.

Since the equivalent impedance $Z_O$ of the variable impedance means 3 connected as the electrical load can be varied, a damping impedance $(Z_O + R_V)$ with respect to the motional impedance $Z_M$ of the electroacoustic conversion means 2 can be desirably controlled. Therefore, the acoustic impedance as passive characteristics with respect to the acoustic energy of the electro-acoustic conversion means 2 can be controlled, and a resonance Q value and a lowest resonance frequency $f_O$ can also be controlled. More specifically, if $Z_O = -R_V$, the motional impedance $Z_M$ is short-circuited at zero Ω, and a diaphragm (cone paper) of the electro-acoustic conversion means 2 essentially serves as a portion of a wall surface of the frame member 1. Therefore, an acoustic energy $P_1$ indicated by a solid arrow in FIG. 1 is completely reflected by the electro-acoustic conversion means 2 (dotted arrow $P_2$), and a maximum sound insulation factor and reflectivity can be realized If a resonance Q value is assumed to be a finite value, the electro-acoustic conversion means 2 allows the acoustic energy $P_1$ in a corresponding resonance region to transmit therethrough, and a transmission sound indicated by a dotted arrow $P_3$ in FIG. 1 appears. The reflection and transmission ranges or degrees, i.e., passive characteristics with respect to the acoustic energy of the acoustic energy field can be continuously and finely changed by desirably setting the setting unit 42 in the circuit show in FIG. 2. However, in practice, the equivalent impedance $Z_O$ of the variable impedance means 3 in a negative region must be set to satisfy $Z_O \geqq -R_V$ with respect to the internal impedance $R_V$ of the electro-acoustic conversion means 3. If this relation cannot be satisfied, oscillation occurs.

In the basic arrangement of this embodiment, the negative impedance is generated to control the resonance Q value and the lowest resonance frequency $f_O$ of the electro-acoustic conversion means 2, thereby varying the acoustic impedance with respect to the acoustic energy. The same effect can be realized by using as an electrical load an equivalent impedance means employing a motional feedback (MFB) circuit. More specifically, a feedback amount is controlled to variably control the lowest resonance frequency f and a resonance Q value near that frequency. Therefore, the acoustic impedance as passive characteristics with respect to the acoustic energy can be continuously and finely controlled In this case, there is no possibility of oscillation from the operation principle.

First to fourth embodiments of the present invention will be described below with reference to FIGS. 3 to 6.

Figure 3:
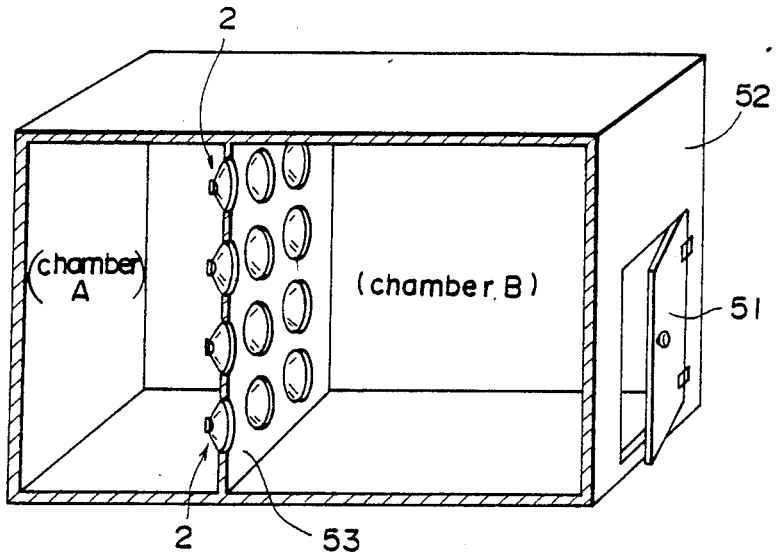
FIGS. 3 to 6(*b*) are sectional views showing first to fourth examples of the first embodiment, respectively.

FIG. 3 is a perspective sectional view of a first embodiment. As shown in FIG. 3, a rectangular prism chamber 52 having a door 51 is partitioned into chambers A and B by a partition plate 53 as a frame member of an acoustic body (or an acoustic characteristics changing device). A plurality of openings are formed in the partition plate 53, and dynamic cone speakers as the electro-acoustic conversion means 2 are mounted in these openings. Each electro-acoustic conversion means 2 is connected to the variable impedance means 3 and the impedance control means 4 shown in FIG. 1 (neither are shown in FIG. 3) as electrical loads, so that the lowest resonance frequency $f_O$ and resonance Q value of the electroacoustic conversion means 2 can be desirably controlled.

In this embodiment, when the electro-acoustic conversion means 2 equivalently becomes a portion of the partition wall 53 (Q=0), an acoustic energy from the chamber A as the acoustic energy field does not reach the chamber B, and the partition plate apparently serves as a sound insulation plate When the equivalent impedance $Z_O$ of the variable impedance means 3 is controlled, a sound insulation factor and a sound insulation frequency range can be varied. Therefore, the partition plate serves as a variable sound insulation plate which can continuously and finely change the sound insulation factor. If the same structure as the partition plate 53 is applied to a wall surface of a hall or the like, sound reflection/absorption characteristics of the hall can be desirably controlled.

Figure 4A:
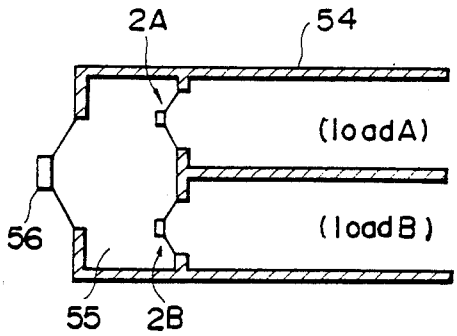
Figure 4B:
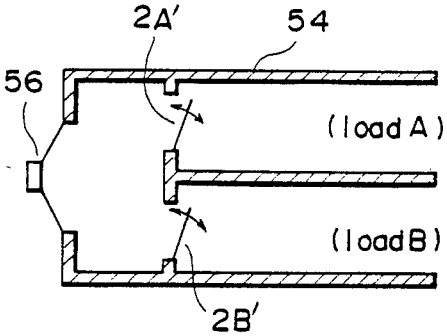

FIGS. 4(*a*) and 4(*b*) show a second embodiment of the present invention, in which FIG. 4(*a*) is a sectional view and FIG. 4(*b*) is a sectional view equivalently expressing FIG. 4(*a*). As shown in FIGS. 4(*a*) and 4(*b*), a frame member 54 of an acoustic body defines two acoustic loads A and B and a resonance chamber 55. Dynamic speakers as electro-acoustic conversion means 2A and 2B are mounted between the resonance chamber 55 and the acoustic loads A and B. Note that each of the electro-acoustic conversion means 2A and 2B is connected to the variable impedance means and the impedance control means (neither are shown) as in the first embodiment. A speaker 56 for driving the resonance chamber is mounted on a wall surface of the resonance chamber 55, and hence, the resonance chamber 55 constitutes an acoustic energy field.

In this embodiment, the electro-acoustic conversion means 2A and 2B serve as acoustic switches 2A′ and 2B′, as shown in FIG. 4(*b*). More specifically, since acoustic impedances of the electro-acoustic conversion means 2A and 2B with respect to the acoustic energy can be ideally switched between an infinite level and zero, the acoustic switches 2A′ and 2B′ are apparently turned on/off. Therefore, the loads A and B respectively having inherent resonance frequencies can be electrically selected Passive characteristics with respect to the acoustic energy can be continuously and finely switched, and the frequency ranges can be desirably set.

Figure 5A:
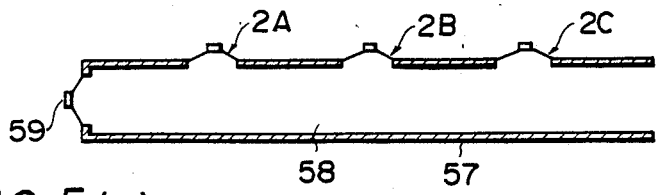
Figure 5B:
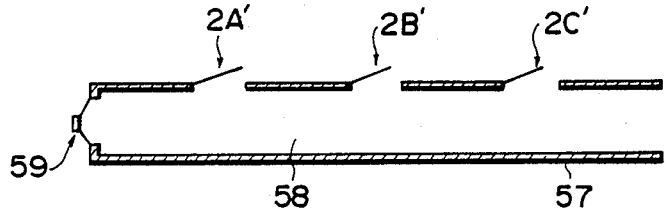

FIG. 5(*a*) and 5(*b*) show a third embodiment of the present invention, in which FIG. 5(*a*) is a sectional view, and FIG. 5(*b*) is a sectional view equivalently expressing FIG. 5(*a*). As shown in FIG. 5(*a*), a frame member 57 of a cylindrical acoustic body defines a resonance chamber 58, and a driving speaker 59 is mounted on one end of the frame member 57. Openings are formed in the frame member 57 at predetermined intervals, and dynamic cone speakers as electro-acoustic conversion means 2A, 2B, and 2C are mounted in these openings. In this embodiment, as shown in FIG. 5(*b*), the electro-acoustic conversion means 2A to 2C serve as acoustic switches 2A′ to 2C′. For this reason, when the acoustic switches 2A′ to 2C′ are apparently turned on/off, the resonance frequency of the resonance chamber 58 can be variably controlled. Since the sound insulation factor of the electroacoustic conversion means 2A to 2C can be continuously and finely controlled, the resonance frequency of the resonance chamber 58 can also be continuously and finely controlled.

Figure 6A:
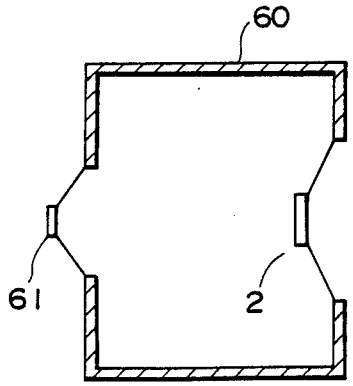
Figure 6B:
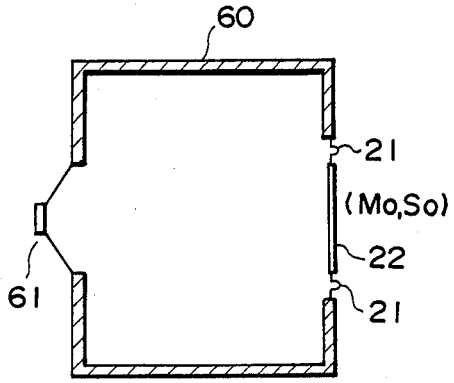

FIGS. 6(*a*) and 6(*b*) show a fourth embodiment of the present invention, in which FIG. 6(*a*) is a sectional view, and FIG. 6(*b*) is a sectional view equivalently expressing FIG. 6(*a*). As shown in FIG. 6(*a*), a frame member 60 of an acoustic body defines a resonance chamber. A driving speaker 61 is mounted on one opening of the frame member 60, and a dynamic cone speaker as the electro-acoustic conversion means 2 according to the present invention is mounted in the other opening. The electro-acoustic conversion means 2 is connected to the variable impedance means and the impedance control means as the electrical loads as in FIG. 1, and an acoustic impedance with respect to the acoustic energy of a resonance chamber as the acoustic energy field can be varied.

According to this embodiment, the electroacoustic conversion means 2 can be equivalently expressed as a passive diaphragm 22 mounted on the frame member 60 at an edge 21, and its equivalent mass $m_O$ and equivalent stiffness $S_O$ can be electrically varied. Therefore, the means 2 can be used as the passive diaphragm having a variable mass and variable stiffness.

As described above, in the first aspect of the present invention, when the equivalent impedance of the variable impedance means is controlled by the impedance control means, the acoustic impedance of the electro-acoustic conversion means with respect to the acoustic energy of the acoustic energy field can be arbitrarily controlled. Therefore, electrical control of the acoustic impedance as passive characteristics with respect to the acoustic energy of the acoustic energy field can be performed, and the acoustic impedance can be continuously and finely controlled.

An acoustic characteristics changing device of the present invention is suitably applied to various audio equipment and electronic musical instruments.

(Second Embodiment)

Figure 7:
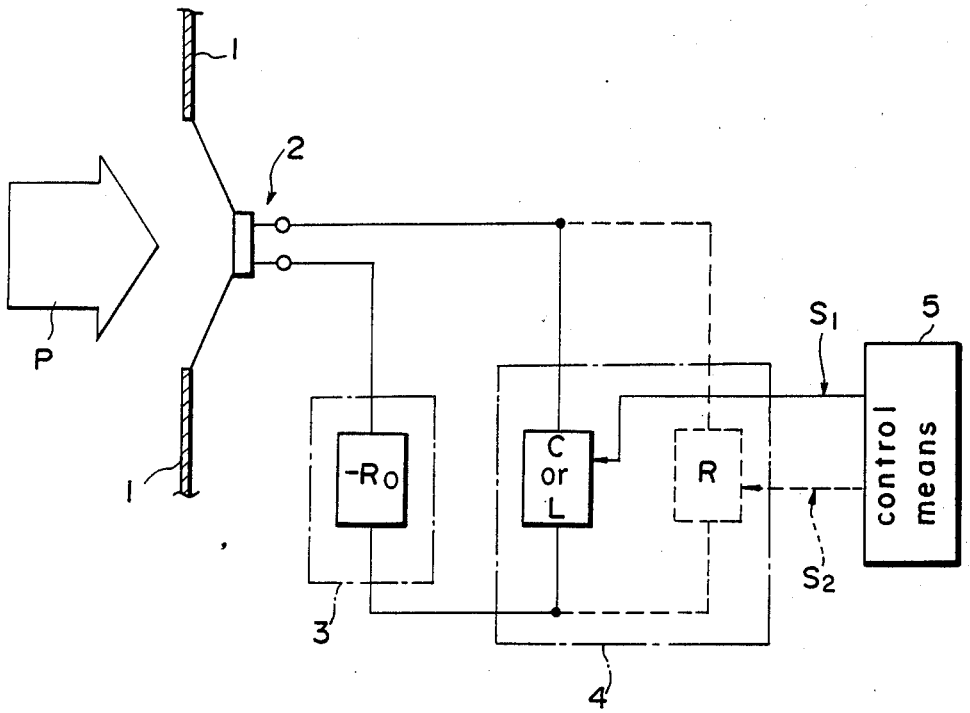
FIG. 7 is a view for explaining a basic arrangement of a second embodiment of the present invention.

FIG. 7 is a block diagram showing a basic arrangement of a second embodiment of the present invention. As shown in FIG. 7, a dynamic cone speaker as an electro-acoustic conversion means 2 is mounted on a frame member 1 of an acoustic characteristics changing device. The electro-acoustic conversion means 2 is connected to a negative impedance means 3 for equivalently generating a negative impedance component ($-R_O$). The negative impedance means 3 is connected in series with a variable impedance means 4. The variable impedance means 4 is connected to an impedance control means 5.

The negative impedance means 3 serves as an electrical load with respect to the electro-acoustic conversion means 2, and equivalently eliminates or invalidates an internal impedance inherent in the electro-acoustic conversion means 2. The variable impedance means 4 has a capacitive (C) or inductive (L) reactance component or a resistance (R) component connected in parallel with the reactance component, as indicated by a dotted line in FIG. 7. The reactance component (C or L) or the resistance component can be varied. This variable control is performed by the impedance control means 5. More specifically, the impedance control means 5 changes the reactance component or the resistance component of the variable impedance means 4 by its outputs $S_1$ and $S_2$, thereby arbitrarily controlling a frequency of decrease of the acoustic impedance of the electro-acoustic conversion means 2 with respect to an acoustic energy of an acoustic energy field or its decrease amount.

Figure 8A:
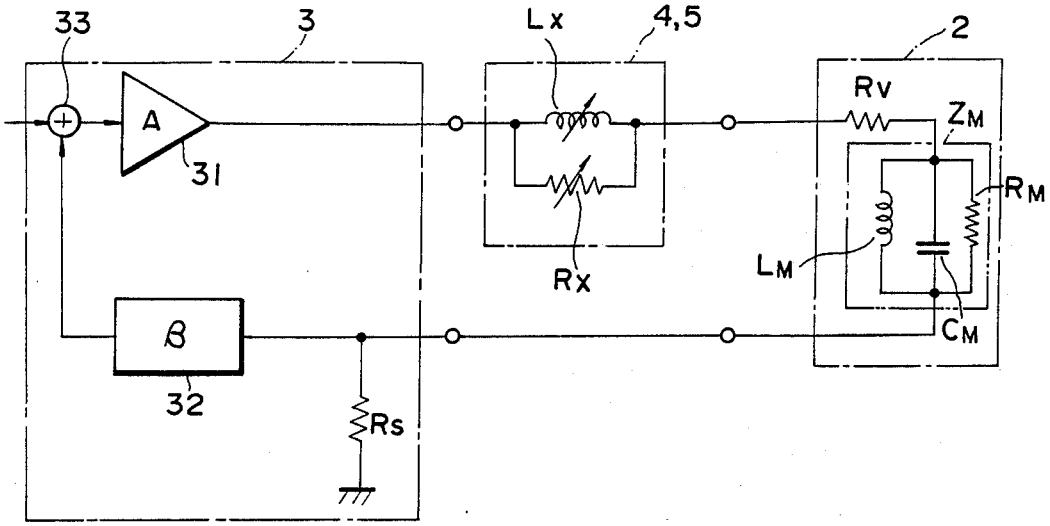
FIGS. 8(*a*) and 8(*b*) are detailed circuit diagrams of the arrangement shown in FIG. 7.
Figure 8B:
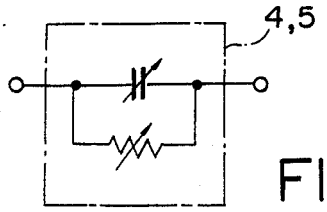

FIGS. 8(*a*) and 8(*b*) are detailed circuit diagrams of the basic arrangement shown in FIG. 7.

As shown in FIG. 8(*a*), the negative impedance means 3 has an amplifier 31 of a gain A, a detection resistor $R_S$ for detecting a current flowing through the electro-acoustic conversion means 2, a feedback circuit 32 for feeding back an output from the resistor $R_S$ with feedback gain $\beta$, and an adder 33 for adding an input signal and the output from the feedback circuit 32 and outputting the sum to the amplifier 31. Therefore, an output impedance ($-R_O$) of the negative impedance means 3 is given by:

$$-R_O = R_S(1 - A\beta)$$

Therefore, the output impedance of the means 3 equivalently eliminates or invalidates the internal impedance $R_V$ inherent in the electro-acoustic conversion means 2. More specifically, when $R_V - R_O > 0$, the internal impedance $R_V$ is equivalently eliminated, and when $R_V - R_O = 0$, it is equivalently short-circuited at zero Ω (invalidated).

The variable impedance means 4 and the impedance control means 5 are formed by a parallel circuit of a variable inductor $L_X$ and a variable resistor $R_X$. The electro-acoustic conversion means 2 connected in series with the parallel circuit is formed to have the internal impedance $R_V$ and a motional impedance $Z_M$. The motional impedance $Z_M$ consists of a parallel circuit of an equivalent inductor $L_M$, an equivalent capacitor $C_M$, and an equivalent resistor $R_M$ having a relatively large resistance, and forms a resonance circuit. Note that the parallel circuit of the variable inductor $L_X$ and the variable resistor $R_X$ may be replaced with a parallel circuit of a variable capacitor $C_X$ and a variable resistor $R_X$, as shown in FIG. 8(*b*).

Figure 9A:
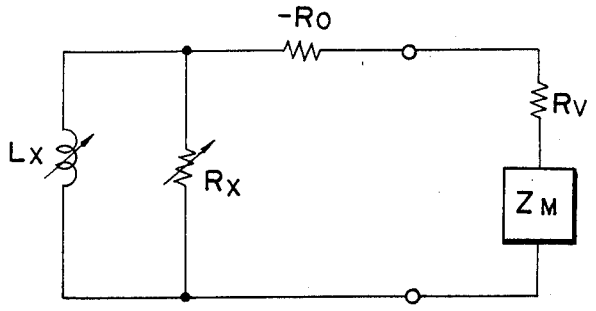
FIG. 9 is an equivalent circuit diagram of FIG. 8.
Figure 9B:
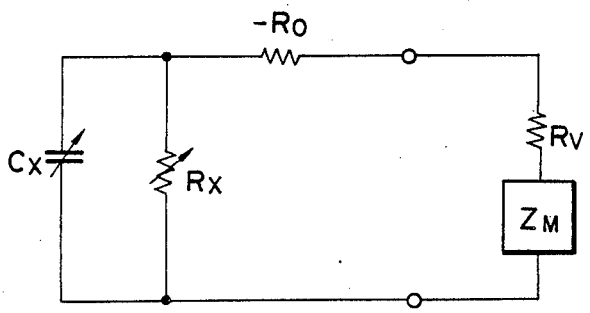

The operation of the basic arrangement will be described below with reference to FIGS. 9(*a*) and 9(*b*).

A drive source can be regarded as voltage source, and hence, it can be considered that the voltage source is short-circuited when a resonance system is taken into account. Therefore, the equivalent circuit shown in FIG. 8(*a*) is simplified as shown in FIG. 9(*a*). In this equivalent circuit, assuming that $R_V - R_O \approx 0$, a series resistance component with respect to the motional impedance $Z_M$ of the electro-acoustic conversion means 2 disappears, and the newly inserted variable inductor $L_X$ or the variable capacitor $C_X$ can directly affect the motional impedance $Z_M$. In addition, a damping resistance component of the motional impedance $Z_M$ becomes substantially zero, and a resonance Q value as a resonance circuit becomes an extremely large value. Therefore, if a new resistance component is inserted, the resonance Q value can be arbitrarily decreased. For this purpose, the variable resistor $R_X$ is connected in parallel with the variable inductor $L_X$ or the variable capacitor $C_X$.

Since the variable inductor $L_X$, the variable capacitor $C_X$, and the variable resistor $R_X$ can be set regardless of a unit, a resonance frequency (sound absorption frequency) $f_x$ and a resonance Q value (sound insulation factor) can be arbitrarily controlled. More specifically, the frequency $f_x$ is decreased to an arbitrary value by the variable capacitor $C_X$, and the Q value can be set to be an arbitrary value by the variable resistor $R_X$. The frequency $f_x$ can be increased to an arbitrary value by the variable inductor $L_X$, and the Q value can be set to be an arbitrary value by the variable resistor $R_X$. Therefore, according to the present invention, the sound absorption frequency and the sound insulation factor at that frequency in passive characteristics with respect to the acoustic energy of the acoustic energy field can be arbitrarily controlled.

Figure 10:
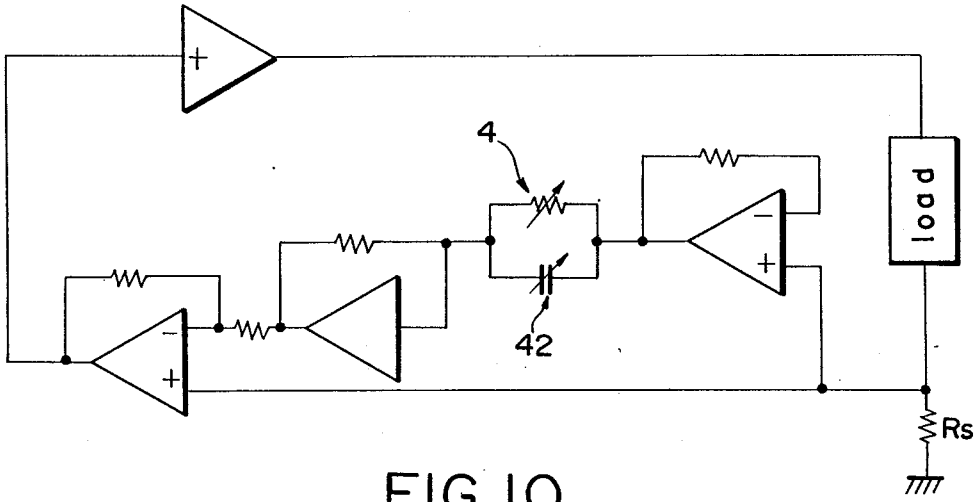
FIG. 10 is a diagram for explaining an equivalent arrangement of a variable impedance.

In FIG. 8(*a*), the variable inductor $L_X$, the variable capacitor $C_X$, and the variable resistor $R_X$ are constituted by actual elements but may be equivalently formed by an electrical circuit. FIG. 10 is a circuit diagram of the electrical circuit. The circuit shown in FIG. 10 has functions of the negative impedance means 2, the variable impedance means 4, and the impedance control means 5 of the circuit shown in FIG. 8. A volume control 41 serves to form the variable resistor $R_X$, and a variable capacitor 42 serves to form the variable capacitor $C_X$.

The present invention is not limited to the above embodiments, and various modifications may be made.

For example, as the variable inductor $L_X$, a coil-slide type inductor or a semiconductor inductor may be used. As the variable capacitor $C_X$, a semiconductor capacitor or the like may be used. When the variable inductor $L_X$, the variable capacitor $C_X$, and the variable resistor $R_X$ are equivalently formed by an electrical circuit, they may be formed independently of the negative impedance means 3 and the like. In this case, the equivalently formed variable inductor $L_X$, variable capacitor $C_X$, and variable resistor $R_X$ are controlled by feedback gain control.

On the other hand, in an acoustic characteristics changing device in which a large number of electro-acoustic conversion means 2 are arranged on the frame member 1, operation members such as variable capacitors, volume controls, and the like may be independently manually operated. However, the large number of operation members may be simultaneously operated by a motor or the like. When the equivalent electrical circuit is formed, a voltage-controlled amplifier (VCA) may be used to allow easy control of a large number of electro-acoustic conversion means 2.

As described above, in the second aspect of the present invention, the reactance component or the resistance component of the variable impedance means is controlled by the impedance control means, so that a decrease frequency of an acoustic impedance of the electro-acoustic conversion means with respect to the acoustic energy of the acoustic energy field or its decrease amount can be arbitrarily controlled. The acoustic impedance is electrically controlled, and hence, passive characteristic with respect to the acoustic energy are continuously and finely changed. Therefore, the sound insulation factor and sound absorption frequency can be continuously and finely controlled.

What is claimed is:

1. An acoustic characteristics changing device comprising:

a frame member of said device disposed in an acoustic energy field;

an electro-acoustic conversion means attached to said frame member to constitute at least a portion of said device;

a negative impedance means, connected as an electrical load to said electro-acoustic conversion means, for generating a negative impedance component for equivalently eliminating or invalidating an internal impedance inherent in said electro-acoustic conversion means;

a variable impedance means which has a reactance component connected in series with said negative impedance means and can vary said reactance component; and an impedance control means which can arbitrarily control a decrease frequency of an acoustic impedance of said electro-acoustic conversion means with respect to an acoustic energy of the acoustic energy field by changing said reactance component of said variable impedance means.

2. An acoustic characteristics changing device according to claim 1, wherein said variable impedance means further comprises a resistance component connected in parallel with said reactance component, the resistance component being also controlled by said impedance control means to control an amount of the acoustic impedance of the electroacoustic conversion means.

3. An acoustic characteristics changing device according to claim 2, wherein said reactance component of the variable impedance means comprises a capacitive reactance component.

4. An acoustic characteristics changing device according to claim 2, wherein said reactance component of the variable impedance means comprises an inductive reactance component.

* * * * *